US005590550A

United States Patent [19]

Savkar et al.

[11] Patent Number: 5,590,550

[45] Date of Patent: Jan. 7, 1997

[54] WASHER AUGER WITH FLEXIBLE RATCHET DRIVE

[75] Inventors: Sudhir D. Savkar, Schenectady; Robert E. Sundell, Clifton Park, both of N.Y.

[73] Assignee: General Electric Company, Schenectady, N.Y.

[21] Appl. No.: 511,941

[22] Filed: Aug. 7, 1995

[51] Int. Cl.[6] ..... D06F 17/08

[52] U.S. Cl. ..... 68/133; 192/46

[58] Field of Search ..... 68/133, 134; 192/46

[56] References Cited

U.S. PATENT DOCUMENTS

| | | | |
|---|---|---|---|
| 4,049,099 | 9/1977 | Zeigler | 192/46 |
| 4,719,769 | 1/1988 | Pielemeier et al. | 68/133 |
| 4,856,303 | 8/1989 | Hood, Jr. et al. | 68/133 |
| 5,088,581 | 2/1992 | Duve | 192/46 |
| 5,257,685 | 11/1993 | Tichiaz et al. | 192/46 |

FOREIGN PATENT DOCUMENTS

| | | | |
|---|---|---|---|
| 91932 | 6/1983 | Japan | 192/46 |

*Primary Examiner*—Philip R. Coe
*Attorney, Agent, or Firm*—Paul R. Webb, II

[57] ABSTRACT

A drive mechanism for converting rotary oscillation of a washing machine clothes agitator to unidirectional rotation of an adjoining clothes auger includes a one-piece ratchet wheel, and a cooperating one-piece pawl wheel. The pawl wheel includes integral pawls, with each pawl having an elastically flexible arm supporting a bulbous distal end. The pawl wheel is fixedly joined to the agitator for rotary oscillation therewith, and the ratchet wheel is fixedly joined to the auger. Rotary oscillation of the agitator correspondingly rotates the pawl wheel for intermittently engaging the pawls with the ratchet teeth which drive the ratchet wheel in a single direction for correspondingly rotating the auger joined thereto.

13 Claims, 5 Drawing Sheets

WASHER AUGER WITH FLEXIBLE RATCHET DRIVE

The present invention relates generally to clothes washing machines, and, more specifically, to a washing machine having a vertical agitator and auger operatively joined together with a ratchet drive.

BACKGROUND OF THE INVENTION

Clothes washing machines can either be vertical or horizontal axis for moving clothes during the washing operation. In the horizontal washing machine, the drum or basket rotates either in one direction or intermittently in both directions causing the clothes therein to tumble during the washing operation in the soap and water cleaning solution. In the vertical washing machine, the agitator reciprocates or oscillates to continually change its rotation direction for moving the clothes to effect cleaning thereof in the cleaning solution.

In order to improve clothes moving in the vertical washing machine, it is known to also include an auger having a spiraling vane or screw disposed coaxially atop the agitator. Disposed between the auger and the agitator is a conventional ratchet mechanism which converts the oscillating, bidirectional rotation of the agitator into unidirectional rotation of the auger so that the auger screw is rotated for pulling of the clothes downwardly in operation in the cleaning solution for improving the effectiveness of the washing operation.

A typical ratchet mechanism includes a disk attached to the top of the agitator from which extend radially outwardly therefrom a plurality of ratchet pawls. A cooperating ratchet wheel in the form of a ring having a plurality of radially inwardly facing ratchet teeth is attached to the bottom of the auger and is disposed in a common axial plane with the pawls. Oscillation of the agitator in turn imparts force on the pawls which intermittently are driven radially outwardly for engagement with the cooperating ratchet teeth. As the agitator rotates in one direction, the pawls are driven radially outwardly and engage the ratchet teeth for also rotating the auger in the same direction. However, when the agitator rotates in the opposite direction, the pawls disengage the ratchet teeth and are indexed to succeeding teeth without imparting additional rotation to the auger. In the next cycle, the ratcheting action is repeated with the auger rotating solely in one direction as the agitator oscillates in two directions.

Since the pawls and teeth are disposed in a common horizontal plane and require initial pivoting of the pawls to engage the teeth, lost motion occurs therefrom. Accordingly, optimum efficiency of conversion of the oscillating agitator rotation to the unidirectional rotation of the auger is not achieved, which correspondingly decreases the efficiency of the washing operation.

Furthermore, typical ratchet mechanisms include many individual components which require suitable assembly and retention provisions, and which adds to the complexity and expense thereof.

SUMMARY OF THE INVENTION

A drive mechanism for converting rotary oscillation of a washing machine clothes agitator to unidirectional rotation of an adjoining clothes auger includes a one-piece ratchet wheel, and a cooperating one-piece pawl wheel. The pawl wheel includes integral pawls, with each pawl having an elastically flexible arm supporting a bulbous distal end. The pawl wheel is fixedly joined to the agitator for rotary oscillation therewith, and the ratchet wheel is fixedly joined to the auger. Rotary oscillation of the agitator correspondingly rotates the pawl wheel for intermittently engaging the pawls with the ratchet teeth which drive the ratchet wheel in a single direction for correspondingly rotating the auger joined thereto.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
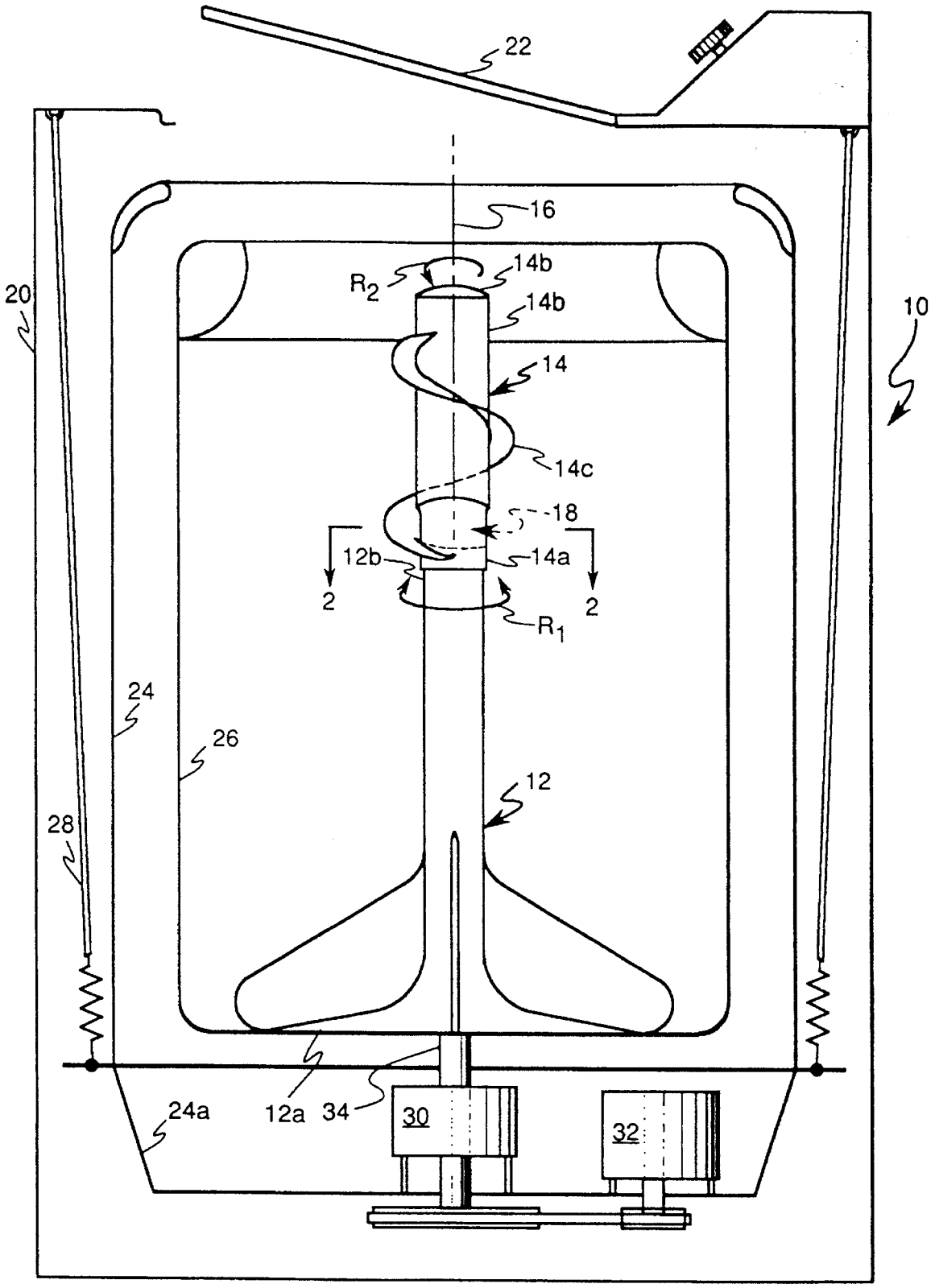
FIG. 1 is a schematic, elevational, partly sectional view of an exemplary vertical agitator washing machine including a coaxial clothes auger joined thereto by a ratchet drive mechanism in accordance with one embodiment of the present invention.

Illustrated schematically in FIG. 1 is an exemplary clothes washing machine 10 having a clothes moving agitator 12 disposed coaxially with a clothes moving auger 14 about a vertical, axial centerline axis 16. A drive mechanism 18 in accordance with the present invention joins the auger 14 to the agitator 12 for converting bidirectional rotary oscillation $R_1$ of the agitator 12 to unidirectional rotary motion or rotation $R_2$ of the coaxially adjoining auger 14.

In the exemplary embodiment illustrated in FIG. 1, the washing machine 10 includes a conventional cabinet or housing 20 with a central opening at its top having a hinged lid 22 which may be opened or closed for loading or unloading clothes, as well as for providing the soap or detergent into the washing machine 10. Disposed inside the housing 20 is a conventional tub 24 open at its top end and configured for containing the washing water therein. Inside the tub 24 is a conventional perforated basket 26 within which are centrally disposed the agitator 12, auger 14, and connecting drive mechanism 18 which are effective for moving clothes placed therein in a soap and water cleaning solution (not shown). The tub 24, as well as the components therein, is conventionally supported in the housing 20 by a plurality of spring suspensions 28.

Suspended from the bottom of the tub 24 is an integral frame 24*a* which supports a conventional transmission 30 and electrical motor 32 operatively joined together by a pulley and belt system. The motor 32 is effective for driving the transmission 30 for oscillating a conventional drive shaft 34 joined to the agitator 12 for imparting the desired bidirectional rotation $R_1$ thereto.

As shown in FIG. 1, the agitator 12 includes a bottom or proximal end 12*a* which is disposed at the bottom of the basket 26 and through which the drive shaft 34 extends axially upwardly and is conventionally fixedly joined to the agitator 12. The agitator 12 includes a top distal end 12*b* which is inserted into a bottom or proximal end 14*a* of the auger 14. The auger 14 has a top or distal end 14*b*, and a conventional vane or screw 14*c* spirals upwardly around the auger 14 from the bottom to top ends 14*a, b*. The auger screw 14*c* has a right-hand spiral in this exemplary embodiment, with the drive mechanism 18 being configured for imparting unidirectional, counterclockwise rotation $R_2$ for pulling the clothes vertically downwardly during the washing operation. In alternate embodiments, the auger screw 14*c* can have a left-hand spiral, with the drive mechanism 18 being oppositely configured for rotating the auger 14 in a clockwise direction.

Figure 2:
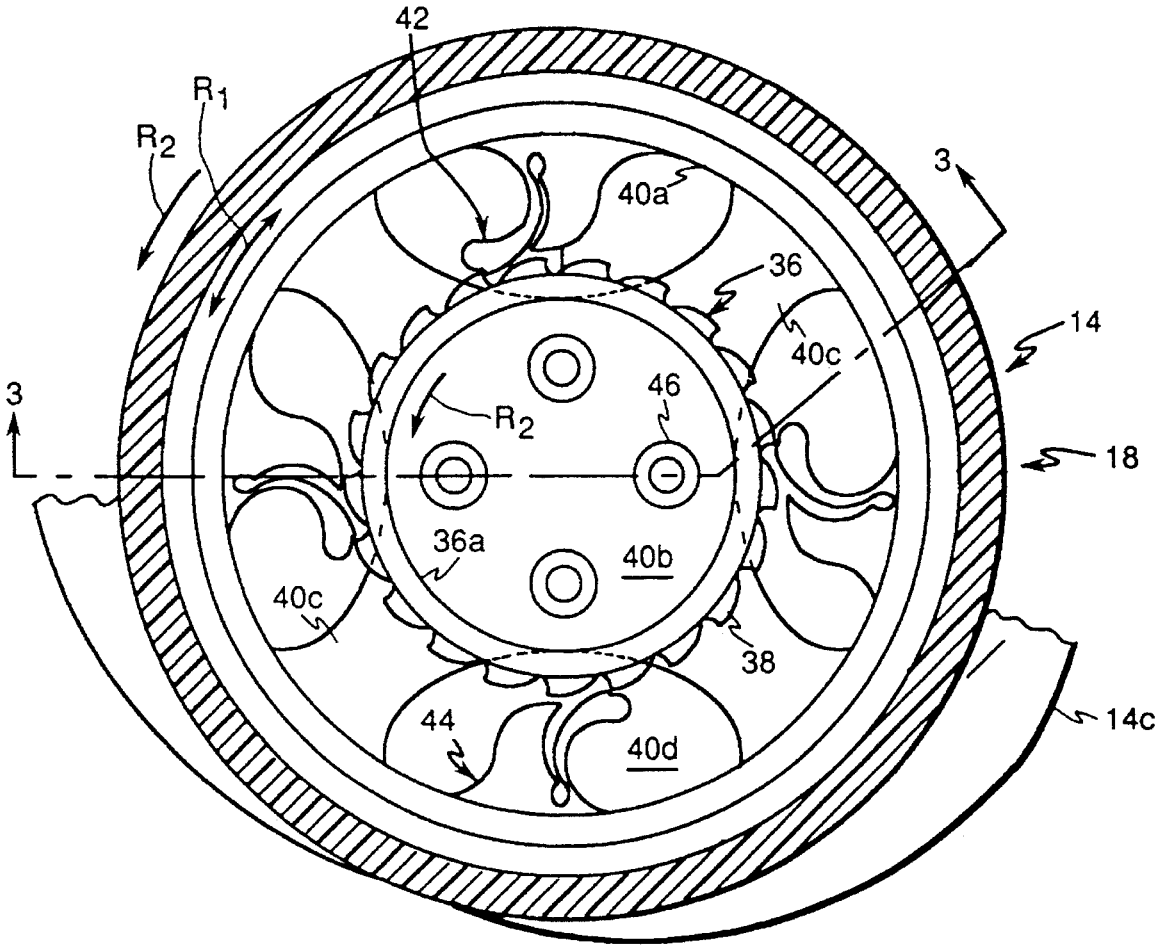
FIG. 2 is a transverse, partly sectional view of the drive mechanism illustrated in FIG. 1 and taken generally along line 2—2.
Figure 3:
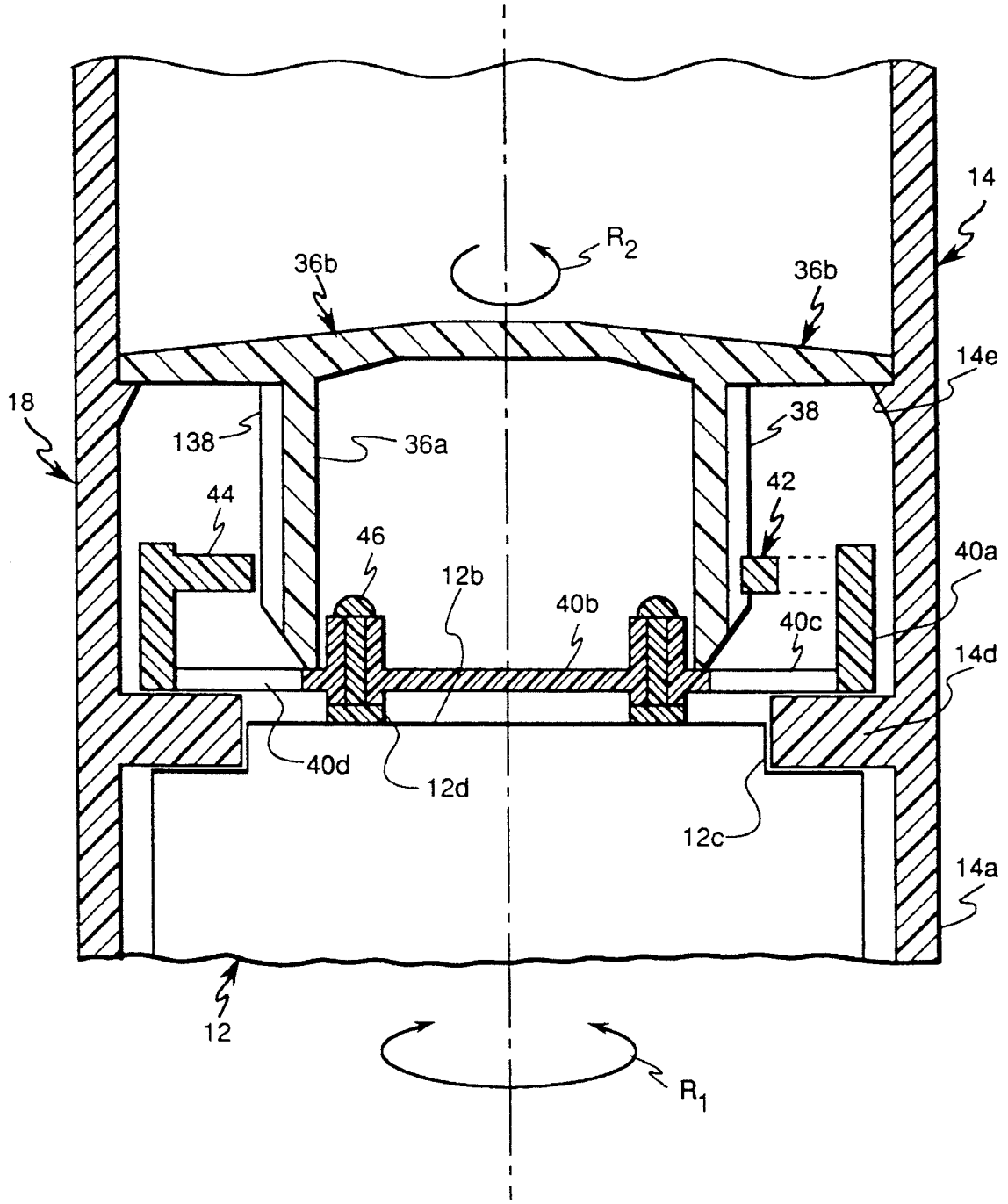
FIG. 3 is an elevational, partly sectional view through the drive mechanism illustrated in FIG. 2 and taken along line 3—3.

The drive mechanism 18 is illustrated in more particularity in FIGS. 2 and 3 in accordance with an exemplary embodiment of the present invention for imparting counterclockwise rotation $R_2$ of the auger 14, since the auger screw 14*c* has a right-hand spiral. As shown, a one-piece ratchet wheel 36 includes a circular or tubular rim 36*a* from which extends radially outwardly, a plurality of circumferentially spaced apart ratchet teeth 38.

Cooperating with the ratchet wheel 36 is a one-piece pawl housing or wheel 40 having a plurality of circumferentially spaced apart integral ratchet pawls 42 extending radially inwardly from an annular pawl rim or ring 40*a*, which pawls 42 are positionable adjacent to the ratchet teeth 38 for ratcheting engagement therewith.

Figure 4:
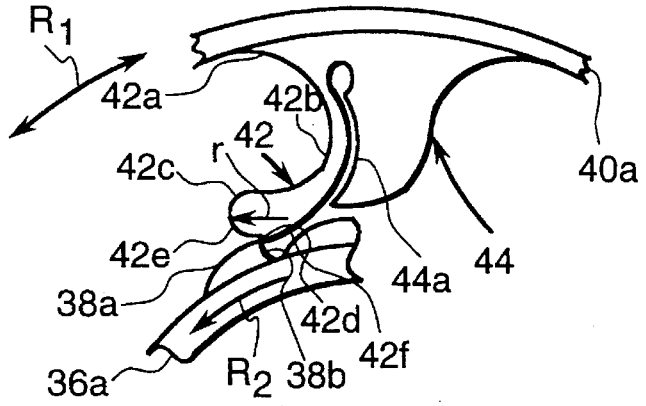
FIG. 4 ms an enlarged top view of an exemplary pawl and cooperating ratchet tooth shown in the drive mechanism illustrated in FIG. 2.

As shown in more particularity in FIG. 4, each of the pawls 42 integrally includes a proximal end 42*a* integrally joined to the pawl rim 40*a;* an intermediate, elastically flexible, thin arm 42*b* extending integrally from the proximal end 42*a;* and a bulbous or enlarged distal end 42*c* extending integrally from the arm 42*b*. A pawl step or tooth 42*d* is disposed on the pawl distal end 42*c* for ratcheting engagement with the ratchet teeth 38 as the pawl arm 2*b* elastically flexes relative thereto.

The pawl distal end 42*c* is preferably enlarged to provide a relatively rigid support for the engaging pawl tooth 42*d*. However, in order to allow the pawl 42 to perform a typical ratcheting function, the pawl arm 42*d* functions as a cantilever spring providing a radially inwardly directed spring biasing force for ensuring suitable engagement between the pawl tooth 42*d* and the ratchet teeth 38. Since the pawl wheel 40, which includes the pawls 42 thereon, is a one-piece collective assembly for reducing individual components, pivoting action of the pawls 42 is provided solely by the flexibility of the pawl arm 42*b*. The flexibility of the pawl arm 42*b* allows the pawl distal end 42*c* to disengage from the ratchet teeth 38 by radially outward movement therefrom when the ratchet wheel 40 rotates in its clockwise half-cycle, with the pawl arm 42*b* providing a radially inwardly directed spring force for ensuring engagement of the pawl distal end 42*c* with the ratchet teeth 38 when the pawl wheel 40 rotates in its counterclockwise half-cycle. Disengagement of the pawls 42 and the ratchet teeth 38 is referred to as the coast cycle, whereas engagement of the pawls 42 and the ratchet teeth 38 is referred to as the drive cycle.

In the drive cycle, the pawl teeth 42*d* are urged into contact with respective ones of the ratchet teeth 38 as the pawl wheel 40 rotates counterclockwise. This loads the pawls 42 in compression and distorts the flexible pawl arms 42*b*. In order to support this compression engagement load, the pawl wheel 40 further includes a plurality of support arms 44 as shown in FIGS. 2 and 4. The arms 44 are also integrally joined to the wheel 40, and adjoin respective ones of the pawls 42 generally coextensively with the pawl arms 42*b* for providing abutting contact therealong to support the pawls 42 under the compression loading thereof which tends to buckle the flexible pawl arms 42*b*. As shown in FIG. 4, the pawl arms 42*b* are arcuate, with the support arms 44 having respective arcuate support faces 44*a* extending generally parallel to the arcuate pawl arm 42*b* with a generally uniform space therebetween when the pawls 42 are unloaded. The pawl distal ends 42*c* project or extend generally circumferentially or tangentially for providing effective engagement and disengagement with the cooperating ratchet teeth 38. In the drive cycle, the pawls 42 engage the ratchet teeth 38 at the respective pawl teeth 42*d* which loads the pawls 42. As the drive load on the pawls 42 increases, the flexible pawl arms 42*b* deflect until they abut the support arms 44 on the surfaces 44*a* which then carry a portion of the drive load therethrough to the rim 40*a* of the pawl wheel 40.

This arrangement allows for a suitably flexible pawl arm 42*b* for allowing pivoting motion of the pawl distal end 42*c* for engagement and disengagement with the ratchet teeth 38 during operation. The support arms 44 provide substantial load carrying capability so that the flexible pawl arms 42*b* need not be made excessively thick which would decrease the required flexibility thereof. As shown in the FIG. 4 embodiment, each of the pawls 42 has only a single one of the support arms 44 disposed solely or only on one side thereof for supporting the pawl arm 42*b* solely along one side.

Figure 5:
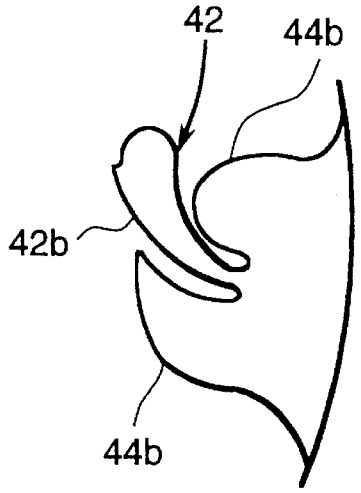
FIG. 5 is a top view of a pawl and cooperating support arm in accordance with another embodiment of the present invention.

In an alternate embodiment illustrated in FIG. 5, each of the pawls 42 has a pair of support arms 44B disposed on opposite circumferential sides thereof for supporting the pawl arm 42*b* along two sides if desired.

Figure 6:
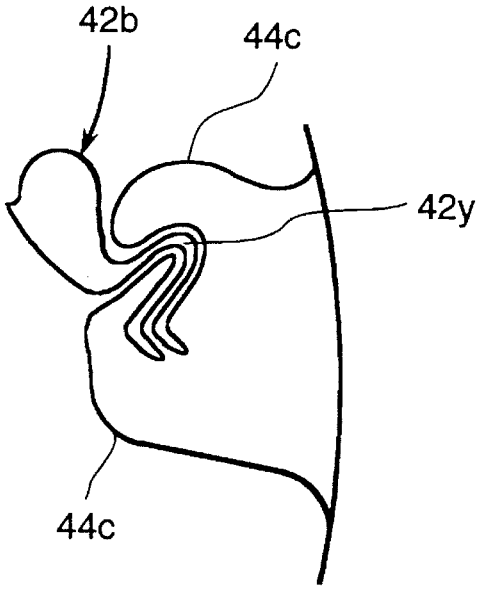
FIG. 6 is a top view of a pawl and cooperating support arm in accordance with another embodiment of the present invention.

FIG. 6 illustrates yet another embodiment wherein the pawl, designated 42B, is supported on two opposite circumferential sides by a respective pair of support arms designated 44C. In this embodiment, however, the pawl arm, designated 42*y* is doubly arcuate, or serpentine in a general "S" configuration with the supporting faces of the support arms 44C being complementary in configuration. This arrangement allows for a more flexible support arm 42*y*, with suitable load support through the cooperating support arms 44C.

Since the pawls 42 are flexibly mounted, it is desirable to reduce sliding engagement thereof with the cooperating ratchet teeth 38 for reducing wear therebetween. As shown in FIG. 4, each of the ratchet teeth 38 acts as a cam lobe during the coast cycle and includes a cam surface 38*a* joined to a transverse, generally radially extending contact surface 38*b*. In the drive cycle, the pawl tooth 42*d* engages the tip of the contact surface 38*b* for imparting counterclockwise unidirectional rotation $R_2$ to the ratchet wheel 36.

Each of the pawl distal ends 42*c* preferably includes an arcuate or circular rolling surface 42*e* directly adjacent to the pawl tooth 42*d* to partially rotate along the cam surface 38*a* upon engagement of the pawl tooth 42*d* with the contact surface 38*b* of the ratchet tooth 38 during the drive cycle. As the pawl wheel 40 rotates counterclockwise, the pawl teeth 42*d* engage the ratchet teeth contact surfaces 38*b*, and since the pawl arms 42*b* are flexible, the pawl distal ends 42*c* will rotate slightly counterclockwise, without disengaging the pawl 42, around the engaging teeth 38, 42*d* shown in the view illustrated in FIG. 4. By shaping the rolling surface 42*e* to a portion of a circular arc of radius r, the counterclockwise rotation of the pawl distal end 42*c* will cause primarily rolling contact between the rolling surface 44*e* and the cooperating portion of the ratchet teeth cam surface 38*a* to reduce wear therebetween.

In the coast cycle, the cam surfaces 38*a* of the ratchet teeth 38 slide against the underside, cooperating cam surface 42*f* which extends away from the pawl tooth 42*d*. This camming movement between the cooperating cam surfaces 38*a* and 42*f* displaces the pawl distal end 42*c* radially outwardly to allow clockwise rotation of the pawl wheel 40 without any corresponding clockwise rotation of the ratchet wheel 36. In order to reduce noise between the engaging and disengaging ratchet tooth 38 and pawl 42, the ratchet tooth cam surface 38*a* preferably has a generally cycloidal contour relative to the circular rim 36*a* which is effective for causing the pawl distal end 42*c* to follow a cycloidal travel path upon relative camming movement therebetween. Cycloidal movement of the distal end 42*c*, at the center of the radius r for example, may be obtained by suitably contouring the ratchet tooth cam surfaces 38*a* based on the dynamic boundary conditions provided for each design. For given rotational speeds $R_1$ and $R_2$, and given mass of the pawls 42, and given flexibilities of the pawl arms 42*b*, the contour of the cam surface 38*a* may be determined for effecting cycloidal travel of the pawl distal ends 42*c*. The contour of the cam surfaces 38*a* will themselves generally be cycloidal but will vary as required for ensuring cycloidal travel of the pawl distal ends 42*c*. In this way, acceleration of the pawls 42 is reduced during operation which reduces or eliminates bouncing of the pawls 42 for reducing noise therefrom.

Noise may be further reduced by minimizing the spring constant of the pawl arms 42*b* which reduces the contact forces between the respective cam surfaces 38*a* and 42*f*.

In the embodiment of the invention illustrated in FIGS. 2 and 3, the ratchet teeth 38 extend radially outwardly from the ratchet wheel 36, and the pawls 42 and support arms 44 extend radially inwardly from the rim 40*a* of the pawl wheel 40. The pawl wheel 40 is fixedly joined to the agitator 12 for oscillatory rotation $R_1$ therewith, with the ratchet wheel 36 being fixedly joined to the auger 14 for unidirectional rotation $R_2$ therewith.

As shown in FIG. 3, the pawls 42 and support arms 44 extend radially inwardly in a common, first horizontal plane at the top of the pawl rim 40*a*. In order to mount the pawl wheel 40 to the agitator 12, the pawl wheel 40 further includes an integral central hub 40*b*, and a plurality of spokes 40*c* extending radially between the hub 40*b* and the pawl rim 40*a* in a common second horizontal plane spaced axially from or below the first plane including the pawls 42 and the support arms 44. As shown in FIG. 2, the spokes 40*c* are circumferentially spaced apart from each other and from the pawls 42 and support arms 44 to define respective access holes or cut-outs 40*d* surrounding the pawls 42 and support arms 44 for allowing conventional single-draw molding of the entire pawl wheel 40 including its integral components, e.g. pawls 42, support arms 44, rim 40*a*, hub 40*b*, and spokes 40*c*, all in a single or one-piece assembly.

As shown in FIG. 3, the agitator 12 further includes an annular step flange 12*c* therearound at its top end 12*b*. The auger 14 is hollow and includes a radially inwardly extending first support flange 14*d* disposed adjacent to the bottom end 14*a* thereof and axially between the rim 40*a* of the pawl wheel 40 and the agitator step flange 12*c*, and is trapped axially therebetween for securing the auger 14 to the agitator 12. As shown in FIGS. 2 and 3, a plurality, four for example, of mounting posts 46 are circumferentially spaced apart from each other and extend axially and integrally from the pawl wheel hub 40*b* and are suitably fixedly joined to corresponding integral posts 12*d* extending upwardly from the agitator top end 12*d*. The corresponding posts 46, 12*d* may be conventionally vibration welded together for securing the entire pawl wheel 40 to the agitator top end 12*d*.

As shown in FIG. 3, the ratchet wheel 36 preferably includes an integral annular cap 36*b* from which extends downwardly the ratchet rim 36*a* and integral ratchet teeth 38. The hollow auger 14 preferably includes a second annular support flange 14*e* spaced suitably axially above the first support flange 14*d* for supporting the perimeter of the ratchet wheel cap 36*b* which is suitably sealingly joined thereto, by vibration welding for example, for creating a conventional air bell below the cap 36*b* for preventing entry of the washing solution therein during operation. The ratchet wheel 36 is therefore fixedly joined to the auger 14 axially above the pawl wheel 40, with the pawls 42 engaging the respective ratchet teeth 38.

Since the ratchet wheel 36 is in the general form of a cup, it too may also be formed by conventional single-draw molding for providing a one-piece assembly of its integral components.

Accordingly, each of the ratchet wheel 36 and pawl wheel 40 is a single piece component assembly which can be economically manufactured using conventional single-draw molding from suitable conventional plastic material such as either filled or unfilled polypropylene. In one embodiment, the pawl wheel 40 may be lubricated acetal, whereas the ratchet wheel 36 is unfilled polypropylene for improving wear resistance between the cooperating cam surfaces 38*a* and 42*f*. The agitator 12 and auger 14 may also be formed of a suitable plastic such as polyproylene.

As shown in FIG. 1, the auger 14 has a suitable cap 14*f* or other suitable cover at the top end 14*b* thereof which is initially removed during the assembly process. The empty auger 14 is firstly inserted axially downwardly on top of the agitator top end 12*b* for receiving the auger first support flange 14*d* into the agitator step flange 12*c* as illustrated in FIG. 3. The pawl wheel 40 may then be simply "dropped in" through the center of the auger 14 into position at the agitator top end 12*b*, with the cooperating posts 46, 12*d* being suitably fixedly joined together. The ratchet wheel 36 may then be inserted downwardly through the auger 14 into position with the ratchet teeth 38 engaging the pawls 42, and the ratchet wheel cap 36*b* being seated in the auger second support flange 14*e* and then conventionally fixedly joined thereto. The auger cap 14*f* may then be joined to the auger top for completing the assembly.

Figure 7:
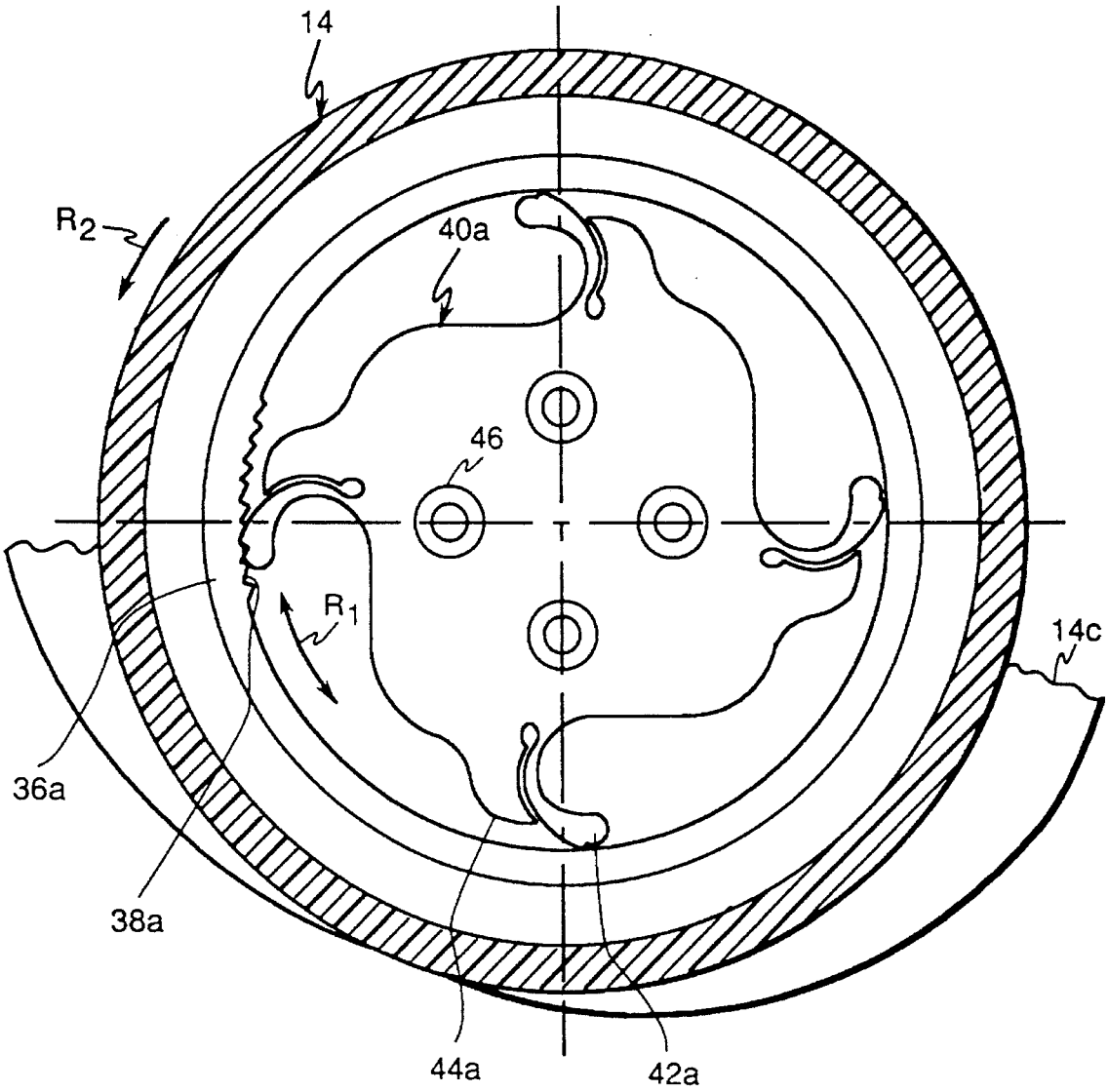
FIG. 7 is a transverse, partly sectional view of a ratchet drive mechanism in accordance with another embodiment of the present invention, and also taken generally along line 2—2 of FIG. 1.

Illustrated in FIG. 7 is an alternate embodiment of the present invention wherein the ratchet wheel, designated 36A, is in the form of a ring, with the ratchet teeth, designated 38A, extending radially inwardly therefrom. The pawl wheel, designated 40A, is in the form of a generally solid disk, with the pawls, designated 42A, and the support arms, designated 44A, extending radially outwardly therefrom. The pawl wheel 40A is fixedly joined to the agitator 12 for oscillatory rotation therewith using the same mounting posts 46 as in the embodiment illustrated in FIG. 3. The ratchet wheel 36A is fixedly joined to the auger 14 for unidirectional rotation therewith in a common horizontal plane with the pawl wheel 40A. The pawls 42A and support arms 44A are configured and function substantially identically to their counterpart pawls 42 and support arms 44 in the embodiment illustrated in FIG. 2. A suitable cap, like cap 36*a*, is mounted to the support flange 14*e* to seal the bottom of the auger and create an air bell around the ratchet and pawl wheels 36A, 38A to prevent contamination thereof.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A drive mechanism for converting rotary oscillation of a washing machine clothes agitator to unidirectional rotation of a coaxially adjoining clothes auger comprising:

a one-piece ratchet wheel having a plurality of circumferentially spaced apart ratchet teeth thereon;

a one-piece pawl wheel having a plurality of circumferentially spaced apart pawls thereon positionable adjacent to said ratchet teeth for ratcheting engagement therewith;

each of said pawls including a proximal end integrally joined to said pawl wheel, an elastically flexible arm extending from said proximal end, a bulbous distal end extending from said arm, and a pawl tooth disposed on said distal end for ratcheting engagement with said ratchet teeth as said arm elastically flexes relative thereto; and a plurality of support arms integrally joined to said pawl wheel and adjoining respective ones of said pawls coextensively with said pawl arms for providing abutting contact therealong to support said pawls under compression loading thereof.

2. A drive mechanism according to claim 1 wherein:

said pawls arms are arcuate;

said support arms have respective arcuate support faces extending generally parallel to said arcuate pawl arms; and said pawl distal ends extend generally circumferentially.

3. A drive mechanism according to claim 2 wherein each of said pawls has one of said support arms disposed solely on one side thereof for supporting said pawl arm thereof solely along one side.

4. A drive mechanism according to claim 2 wherein each one of said pawls has a pair of said support arms disposed on opposite sides thereof for supporting said pawl arm thereof along two sides.

5. A drive mechanism according to claim 4 wherein each of said pawl arms is serpentine, and said support faces of said support arms are complementary in configuration.

6. A drive mechanism according to claim 2 wherein:

each of said ratchet teeth includes a cam surface joined to a transverse contact surface; and each of said pawl distal ends includes an arcuate rolling surface adjacent to said pawl tooth for rolling along said cam surface upon engagement of said pawl tooth with said ratchet tooth contact surface.

7. A drive mechanism according to claim 6 wherein said ratchet tooth cam surface has a generally cycloidal contour effective for causing said pawl distal ends to follow a cycloidal travel path upon relative camming movement therebetween.

8. A drive mechanism according to claim 2 wherein:

said ratchet teeth extend radially outwardly from said ratchet wheel; and said pawls and support arms extend radially inwardly from said pawl wheel.

9. A drive mechanism according to claim 8 wherein said pawl wheel further integrally includes:

a pawl rim from which said pawls and support arms extend radially inwardly in a first plane;

a central hub, and a plurality of spokes extending radially between said hub and said pawl wheel rim in a second plane spaced axially from said pawls and support arms; and said spokes are circumferentially spaced apart from each other and from said pawls and support arms to define respective cut-outs surrounding said pawls and support arms for allowing single-draw molding of said pawl wheel in one piece.

10. A drive mechanism according to claim 9 in combination with said agitator and said auger, and wherein:

said pawl wheel is fixedly joined to said agitator for oscillatory rotation therewith; and said ratchet wheel is fixedly joined to said auger for unidirectional rotation therewith.

11. A drive mechanism according to claim 10 wherein:

said agitator includes a top end having an annular step flange therearound, and said pawl wheel is fixedly joined to said agitator top end;

said auger is hollow with a radially inwardly extending support flange disposed axially between said pawl wheel and said agitator step flange for securing said auger to said agitator; and said ratchet wheel is fixedly joined to said auger axially above said pawl wheel.

12. A drive mechanism according to claim 2 wherein:

said ratchet teeth extend radially inwardly from said ratchet wheel; and said pawls and support arms extend radially outwardly from said pawl wheel.

13. A drive mechanism according to claim 12 in combination with said agitator and said auger, and wherein:

said pawl wheel is fixedly joined to said agitator for oscillatory rotation therewith; and said ratchet wheel is fixedly joined to said auger for unidirectional rotation therewith.

* * * * *